US008511520B2

(12) United States Patent
Van Wijk et al.

(10) Patent No.: US 8,511,520 B2
(45) Date of Patent: Aug. 20, 2013

(54) ERGONOMIC PORTION MEASURING FLUENT MATERIAL DISPENSING SYSTEM

(75) Inventors: Adrian Albert Van Wijk, Vancouver (CA); Samuel Charles Richards, North Vancouver (CA); James William McDonald, North Vancouver (CA)

(73) Assignee: JDi Design Inc., Vancouver, BC (CA)

( * ) Notice: Subject to any disclaimer, the term of this patent is extended or adjusted under 35 U.S.C. 154(b) by 0 days.

(21) Appl. No.: 13/403,519

(22) Filed: Feb. 23, 2012

(65) Prior Publication Data

US 2012/0228334 A1 Sep. 13, 2012

Related U.S. Application Data

(60) Provisional application No. 61/451,497, filed on Mar. 10, 2011.

(30) Foreign Application Priority Data

May 20, 2011 (CA) ..... 2741062

(51) Int. Cl.
*B67D 7/60* (2010.01)
*B65D 88/54* (2006.01)

(52) U.S. Cl.
USPC ..... 222/391; 222/309; 222/326; 222/327; 222/287; 222/387

(58) Field of Classification Search
USPC ..... 222/391, 309, 324, 326, 327, 287, 222/387; 425/87
See application file for complete search history.

(56) References Cited

U.S. PATENT DOCUMENTS 512,930 A * 1/1894 Witte ..... 222/323
958,994 A 5/1910 Davis
1,397,510 A * 11/1921 Grassi ..... 425/376.1
2,517,796 A * 8/1950 Mathis ..... 222/214
2,634,692 A * 4/1953 Sherbondy ..... 425/172
3,161,325 A 12/1964 Hinkel
3,174,653 A * 3/1965 McEachran ..... 222/181.2
4,318,499 A 3/1982 Hamilton
4,323,176 A 4/1982 Sartain
4,330,070 A * 5/1982 Doubleday ..... 222/43
4,966,537 A 10/1990 Bowles et al.
5,297,702 A 3/1994 Crosby et al.
5,375,740 A 12/1994 Umetsu et al.
5,392,956 A * 2/1995 Keller ..... 222/1
5,971,230 A * 10/1999 Tanaka ..... 222/402.11
6,026,985 A 2/2000 Elliott
7,037,094 B1 * 5/2006 Lee ..... 425/12
7,506,783 B2 * 3/2009 Brennan et al. ..... 222/137
7,850,045 B2 * 12/2010 So et al. ..... 222/132
8,235,255 B2 * 8/2012 Springhorn et al. ..... 222/386
2010/0089953 A1 4/2010 Lakie

* cited by examiner

*Primary Examiner* — Kevin P Shaver
*Assistant Examiner* — Nicholas J Weiss
(74) *Attorney, Agent, or Firm* — Steven H. Washam; Harper Washam LLP

(57) ABSTRACT

A fluent material dispensing system comprising: a bottle, a plunger engaged inside the bottle, and a dispensing mechanism having a lever for operation of the plunger for fluid expulsion. The plunger may frictionally engage the bottle to a degree sufficient for holding the plunger in place against a force applied due to return motion of the lever. The dispensing mechanism may comprise a cap for attachment to an end of the bottle opposite a fluid outlet and a handle attached to the cap, the lever pivotally coupled to the cap, the lever and the handle aligned with the bottle. The dispensing mechanism may comprise a portioning mechanism configured to limit distance travelled by the lever from the rest position to the engaged position to a defined amount, thereby limiting expulsion of the fluid to a corresponding defined portion.

13 Claims, 12 Drawing Sheets

10
12
12
100
26
24
24
26
94

12
98
20
58
42
44
100
74
102
18
48
16
46

Fig. 10a
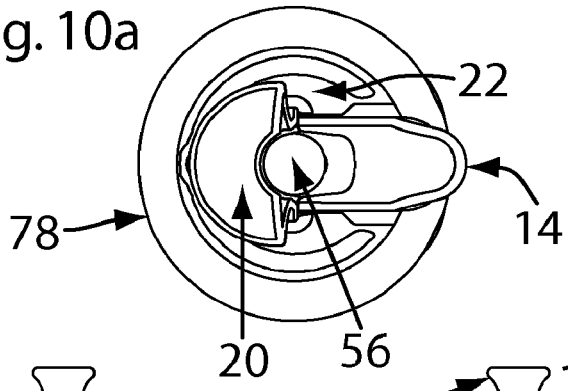
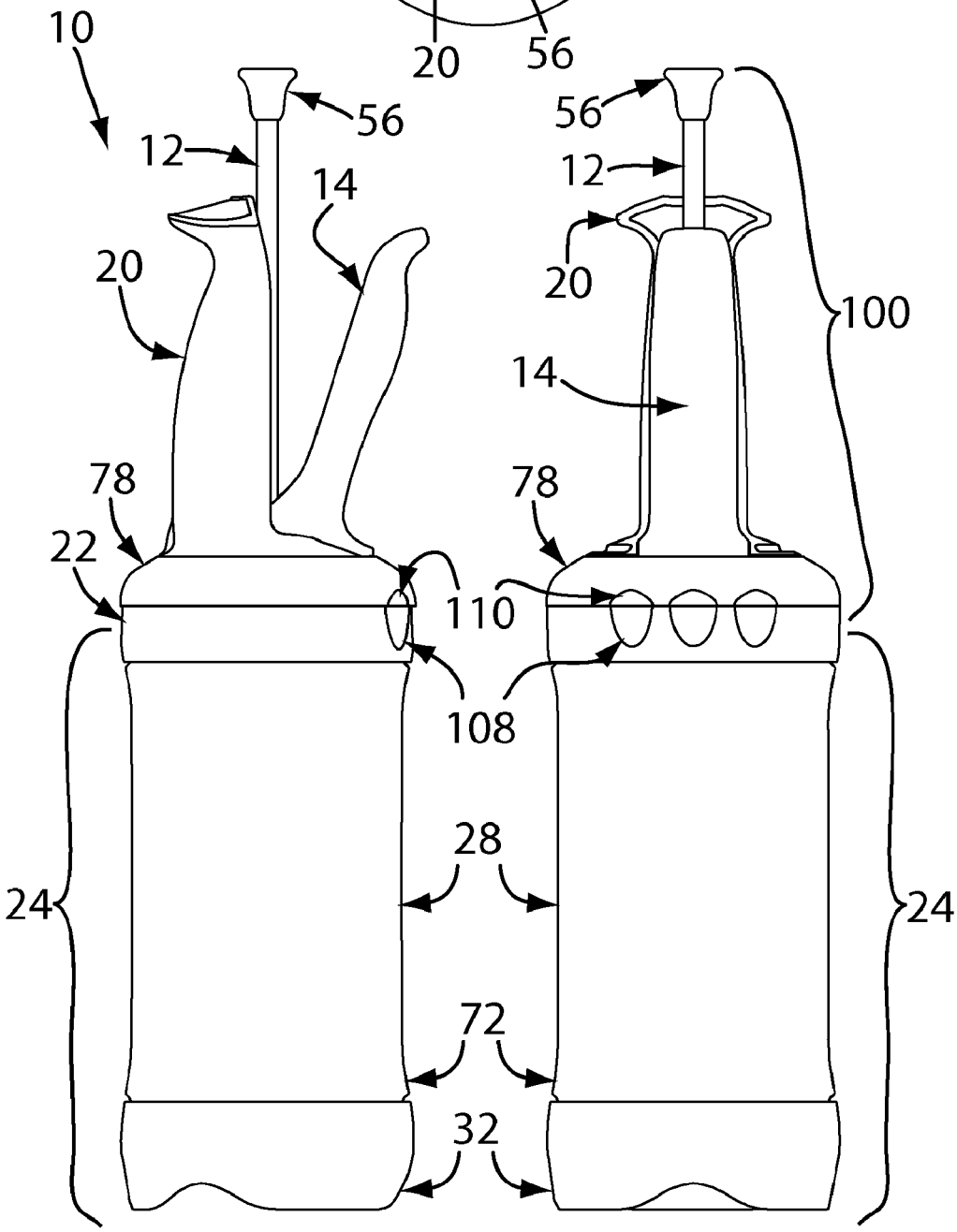
Fig. 10b Fig. 10c

ERGONOMIC PORTION MEASURING FLUENT MATERIAL DISPENSING SYSTEM

FIELD OF INVENTION

This invention relates in the general field of fluent material dispensers and more specifically to a dispensing system with ergonomic inline actuation integrated with portion measuring and modular attributes that contribute to food safety, ease of use and storage efficiency.

BACKGROUND OF THE INVENTION

Quick Service Restaurants often require a means to dispense various sauces & condiments (fluent materials) onto food in a controllable, foodsafe, and efficient manner. Fluent materials include foodstuffs ranging from oils and vinegars, viscous sauces like mayonnaise, and from smooth to chunky sauces containing particles such as chopped onion or chili seeds. Prior art sauce dispensers are often based on known devices such as caulking guns or cake-icing dispensers to dispense fluent materials, but because they evolved from devices used for a different purpose, they often do not perform as well for the purpose at hand.

Fluent material dispensers styled after caulking guns are not ergonomic to use because their means of dispensing, their handle/trigger mechanism, is ninety degrees from the direction of fluent material discharge. To dispense accurately with a gun styled dispenser, the user is forced to use two hands to stabilize the dispenser because its weight is extended away from the handle. When dispensing with one hand, the user's wrist fatigues and accuracy is reduced. Using both hands to dispense increases the liability of inadvertent user contact with the food, as well as with other food preparers in confined spaces and contributes to lowered efficiency and increased preparation times.

Dispensers with gun-like or side projecting handle/triggers often obstruct a clear view of the dispensing target when used, thereby causing wasted food, lost efficiency and higher cost to the consumer. For the same reason, dispensers with a handle/trigger that projects away from the sides of its fluent material container require a lot of room to store because their handle interferes with adjacent dispensers. This can be problematic as sauces are often stored on a preparation rack and/or in a refrigerator.

Most prior art dispensers are a single unit, dispensing mechanism and fluent material storage container. This requires the purchase of redundant dispensing mechanisms and their storage with each dispenser, thus adding to cost, clutter, increased handling and washing, and the like.

A number of prior art designs of fluent material dispensers stand upright on their non-dispensing end leaving their dispensing end exposed to contamination, as well as causing their contents to flow to the non-dispensing end. This deficiency requires that the user attempt to reverse the direction of the fluent material in order to dispense by shaking, jerking and hitting the dispenser. This requirement is inefficient, unsafe and a poor design.

Prior art designs dispense fluent materials with pistons that rely on a perfect seal with the inside wall of the dispensing container. This creates the unnecessary requirement that the user fills the dispensing container extremely accurately or an air pocket will be formed between the piston and the foodstuff when the piston is pushed into the dispensing container. The result is that sauce is spilled onto countertops or the floor, instead of dispensed onto the target food, and fouls the dispenser as well as creates a messy work environment. Without a means to expel any air between the fluent material and the container's piston, foodstuffs will be wasted which will require more rigorous cleaning of dispensers and added expense. Also, current designs have many extraneous and complex parts that are often hard to clean, which is an important factor when food safety and product maintenance is an issue.

Another requirement in a Quick Service Restaurant environment is the repeatable and accurate dispensing of fluent materials. Common prior art sauce dispensers have limited means to adjust accurate dispensing volumes, requiring much skill to dispense a known quantity and are often wasteful. Anyone who has ever used a traditional caulking gun knows the disaster that occurs when one squeezes the trigger mechanism too hard. With less viscous materials however, the need to dispense accurately is necessary, but present devices do not have easy or efficient means to adjust the dispenser to produce different dispensing volumes as needed for different foodstuffs. At best, a means to arrest the range of motion is available in some prior art, but the mechanism must be manually adjusted each time one wants to dispense different volumes, which often requires laborious disassembly of the dispenser or requires special tools.

Therefore there is a need for a fluent material dispensing system that is not subject to one or more limitations of the prior art.

This background information is provided for the purpose of making known information believed by the applicant to be of possible relevance to the present invention. No admission is necessarily intended, nor should be construed, that any of the preceding information constitutes prior art against the present invention.

BRIEF SUMMARY OF THE INVENTION

An object of the present invention is to provide a fluent material dispensing system. In accordance with an aspect of the present invention, there is provided a fluent material dispensing system comprising: a bottle configured for holding the fluent material; a plunger configured for sliding engagement with inner sidewalls of the bottle, the plunger further configured to exert a compressive force on the fluent material when travelling through the bottle interior in a first direction, thereby facilitating expulsion of the fluent material through an outlet of the bottle; and a dispensing mechanism comprising a lever operable between a rest position and an engaged position, the dispensing mechanism configured to cause the plunger to travel in the first direction as the lever moves from the rest position to the engaged position; wherein the plunger is configured to frictionally engage the inner sidewalls of the bottle to a degree sufficient for holding the plunger substantially in place against a force oriented opposite the first direction, the force applied by the dispensing mechanism due to return motion of the lever from the engaged position to the rest position.

In accordance with another aspect of the present invention, there is provided a fluent material dispensing system comprising: a bottle configured for holding the fluent material; a plunger configured for sliding engagement with inner sidewalls of the bottle, the plunger further configured to exert a compressive force on the fluent material when travelling through the bottle interior in a first direction, thereby facilitating expulsion of the fluent material through an outlet of the bottle; and a dispensing mechanism comprising a lever operable between a rest position and an engaged position, the dispensing mechanism configured to cause the plunger to travel in the first direction as the lever moves from the rest position to the engaged position; wherein the dispensing mechanism further comprises: a cap for attachment to an end of the bottle opposite the outlet; and a handle attached to the cap, the lever pivotally coupled to the cap, the lever and the handle extending away from the bottle along an axis which is aligned with the first direction and which passes substantially through a center of the bottle.

In accordance with another aspect of the present invention, there is provided a fluent material dispensing system comprising: a bottle configured for holding the fluent material; a plunger configured for sliding engagement with inner sidewalls of the bottle, the plunger further configured to exert a compressive force on the fluent material when travelling through the bottle interior in a first direction, thereby facilitating expulsion of the fluent material through an outlet of the bottle; and a dispensing mechanism comprising a lever operable between a rest position and an engaged position, the dispensing mechanism configured to cause the plunger to travel in the first direction as the lever moves from the rest position to the engaged position, wherein a distance travelled of the plunger in the first direction increases with a distance travelled by the lever from the rest position to the engaged position; wherein the dispensing mechanism further comprises a portioning mechanism configured to limit the distance travelled by the lever from the rest position to the engaged position to a defined amount, thereby limiting the distance travelled by the plunger to limit an expelled amount of the fluent material to a corresponding defined portion.

Embodiments of the Ergonomic Portion Measuring Fluent Material Dispensing System (hereafter abbreviated as a "Dispenser") are designed to provide an integration of needed design and functional elements that allow accurate, versatile and repeatable fluent material dispensing with a form factor that allows ergonomic use, compliance with foodsafe standards, and efficient operation, cleaning and storage options.

Embodiments of the disclosed Dispenser permit one handed ergonomic operation which reduces user fatigue, improves productivity, food safety, and dispensing accuracy. The handle orientation of the Dispenser permits efficient use of storage space, and its modular design permits efficient deployment of only those dispensing mechanisms necessary, thereby improving logistics. As is readily apparent from the description and figures, the handle is located and oriented along an axis of the bottle and the rod which operates the plunger. The handle and lever are formed around the rod. This orientation provides for ergonomic benefits and a vertical footprint for efficient use of storage space. The Dispenser is designed with fewer and simpler parts than some prior art solutions, which produce a more robust design when operated and cleaned repeatedly.

In accordance with embodiments of the invention, a means to accurately dispense known fluent material volumes and for the user to easily adjust dispensing volumes is provided. Also a means to safely and fully encapsulate fluent materials for optimal storage. While the Dispenser can be used for edible condiments in a foodsafe environment, it can also be employed for use with any flowable or liquid non-edible fluent materials, such as adhesives, cements, gels, etc.

Embodiments of the present invention provide for one or more of the following features, among other features as described herein. A means for one handed ergonomic operation of a fluent material dispenser for the food service industry, as well as in similar environments. A design that permits the efficient and compact storage of filled fluent material containers. A system which permits fluent material containers to be filled and stored separately, and dispensing mechanisms to be fitted to the containers when needed for dispensing operations. A means to safely and fully encapsulate fluent materials in their storage container and employ a small number of easy to clean parts. A means to accurately dispense known fluent material volumes and for the user to easily adjust dispensing volumes is needed.

BRIEF DESCRIPTION OF THE DRAWINGS

FIG. 6*a*, is a Top & partial cutaway view of Lever positioned above a

Portion Stop of an Adjustable Portion Ring, in accordance with embodiments of the present invention.

Figure 6B:
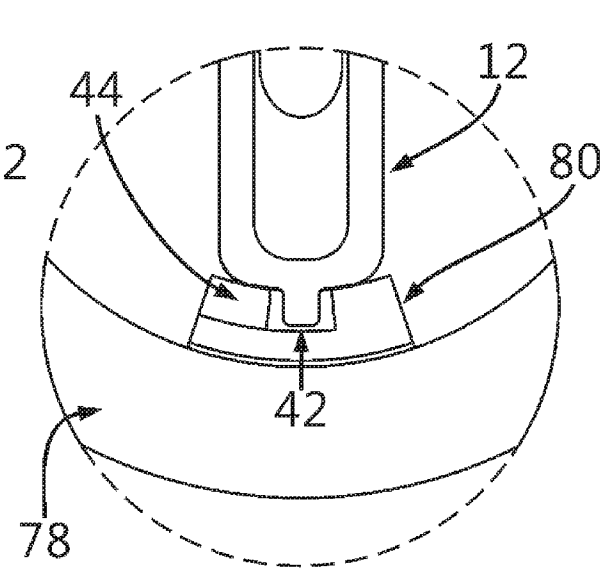
Figure 6A:
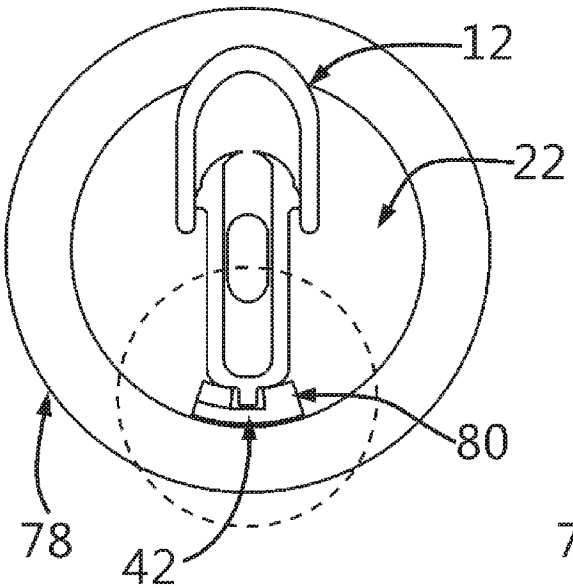

FIG. 6*b*, is a Closeup view of circled area in FIG. 6*a*, in accordance with embodiments of the present invention.

Figure 6C:
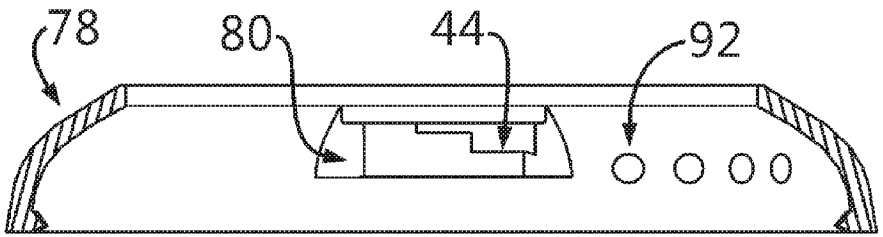

FIG. 6*c*, is a Side Cutaway view of Adjustable Portion Ring, in accordance with embodiments of the present invention.

Figure 7B:
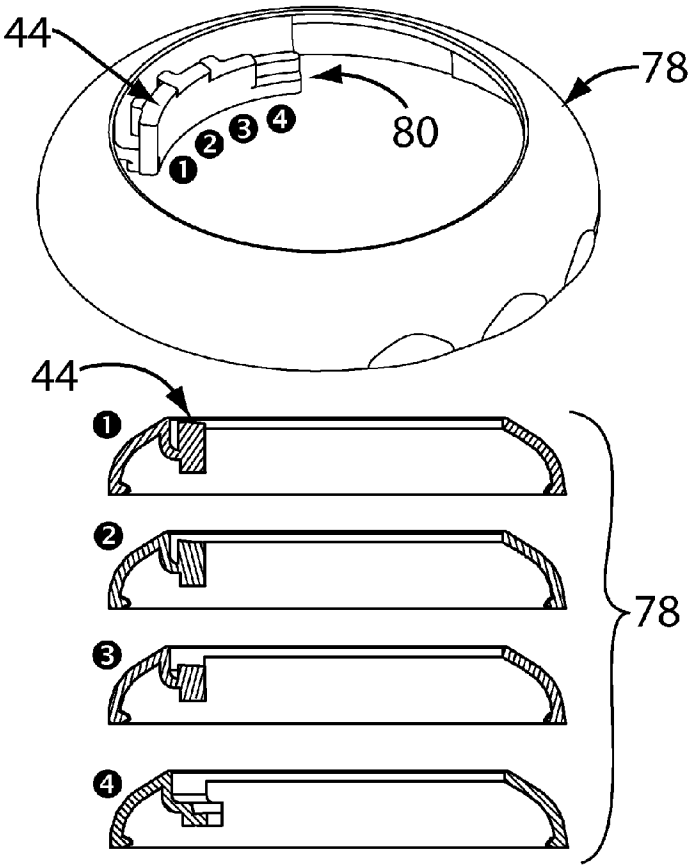
Figure 7A:
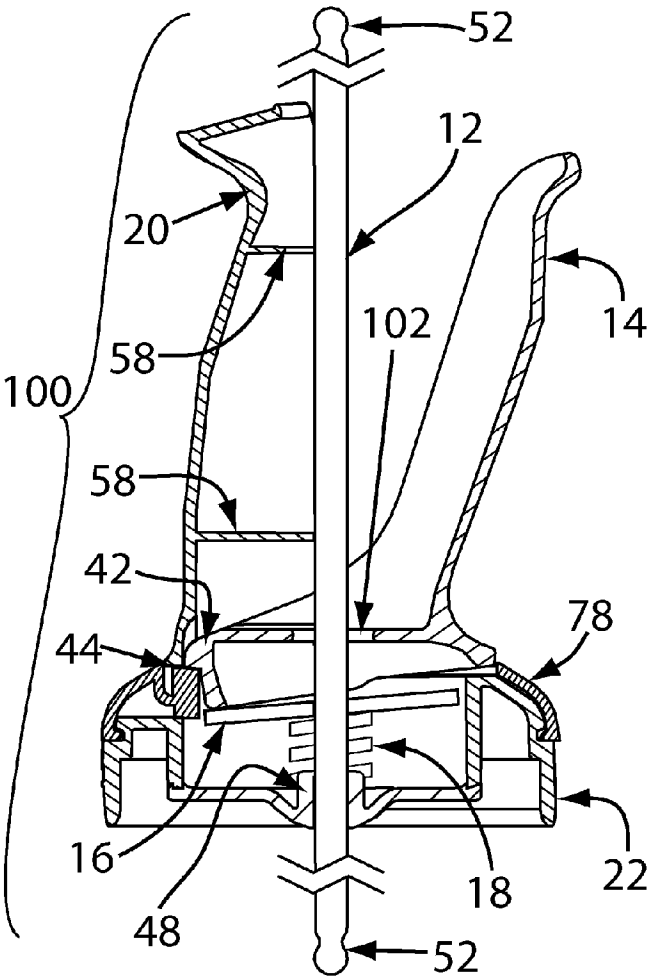

FIG. 7*a*, is a Side Cutaway Closeup view of Handle Cap, Lever, Adjustable Portion Ring & Rod, in accordance with embodiments of the present invention.

FIG. 7*b*, is an Isometric view of an Adjustable Portion Ring and Side cutaway views of each portion stop shown by corresponding number above, in accordance with embodiments of the present invention.

Figures 8A, 8B, 8C, 8D:
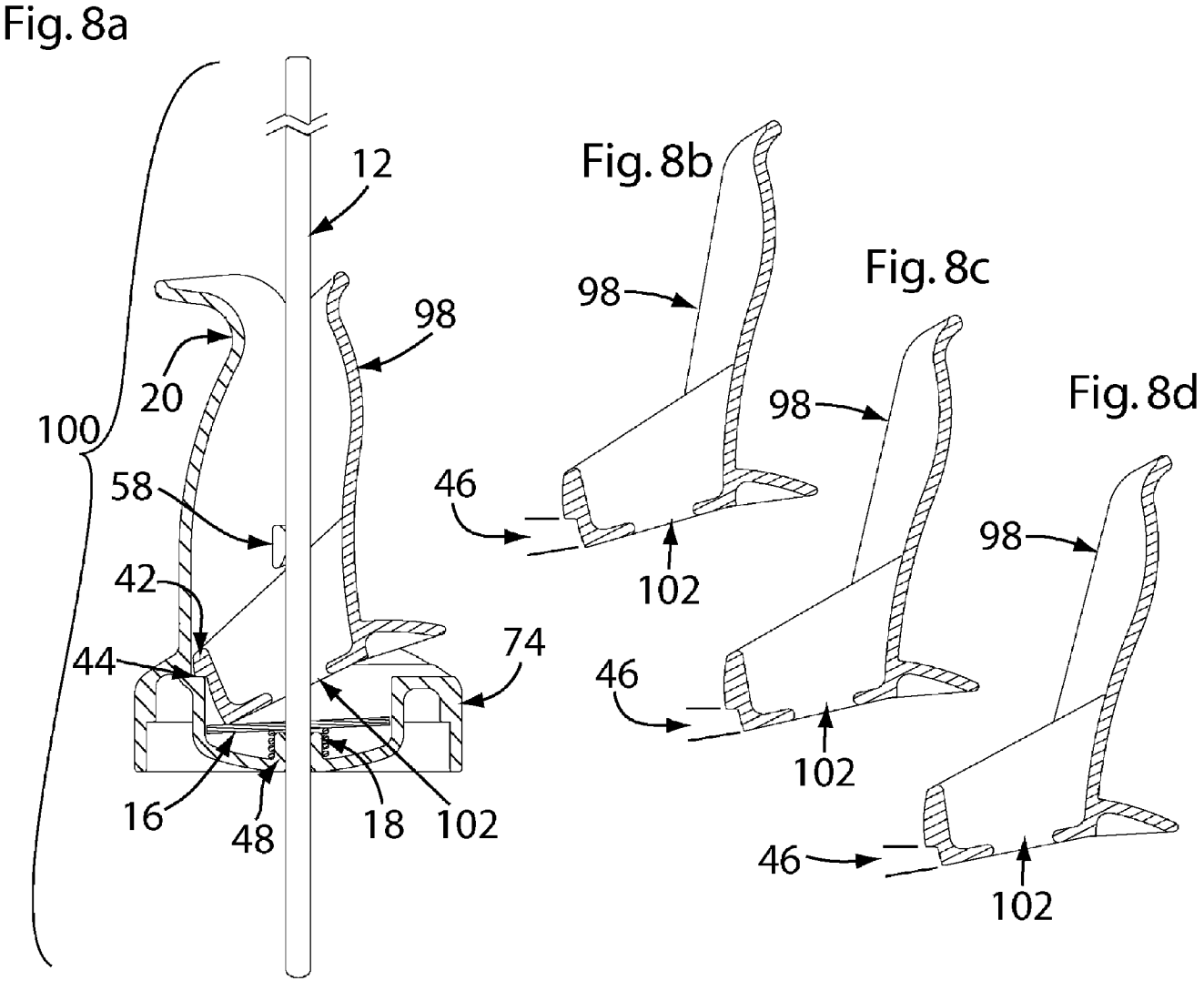

FIGS. 8*a*/8*b*/8*c*/8*d*, are Side Cutaway view of Ringless Handle Cap employing Portion Levers with different travel ranges, in accordance with embodiments of the present invention.

Figure 9B:
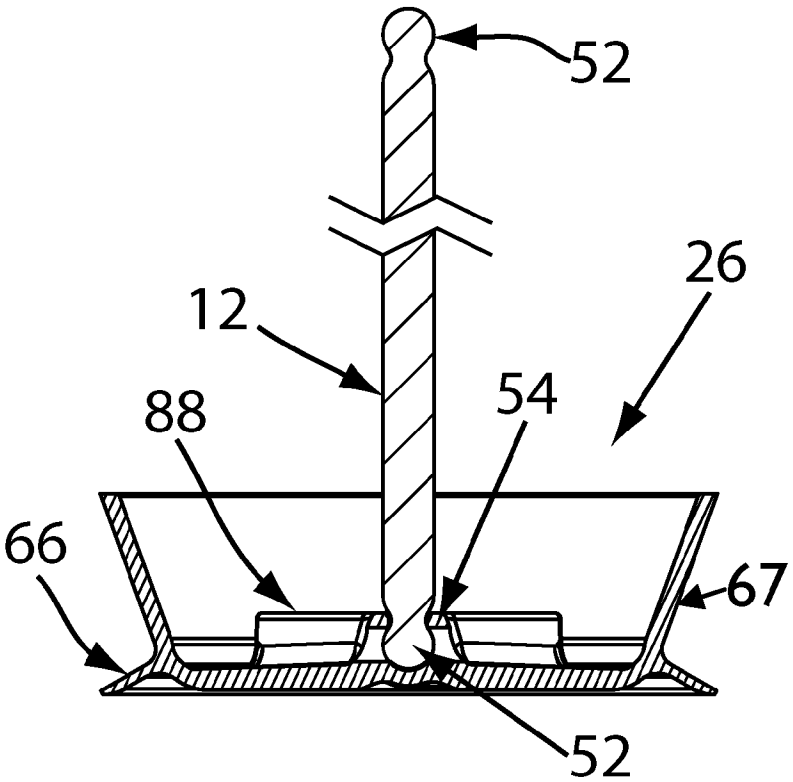
Figure 9A:
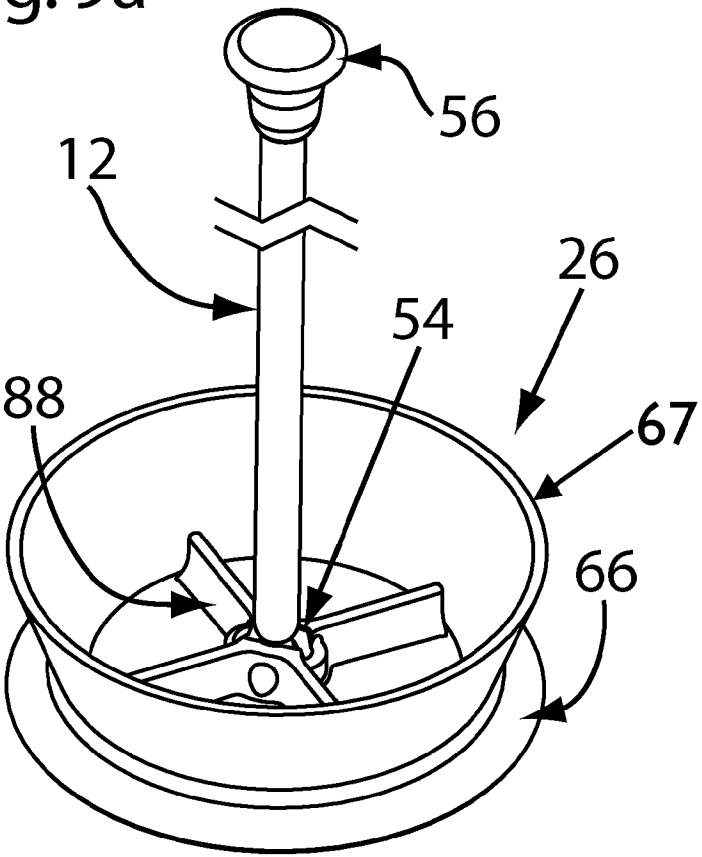

FIGS. 9*a*/9*b*, are Isometric and Side cutaway views of Rod and Plunger, in accordance with embodiments of the present invention.

FIGS. 10*a*/10*b*/10*c*, are Top & two Side views of Dispenser, in accordance with embodiments of the present invention.

Figure 11:
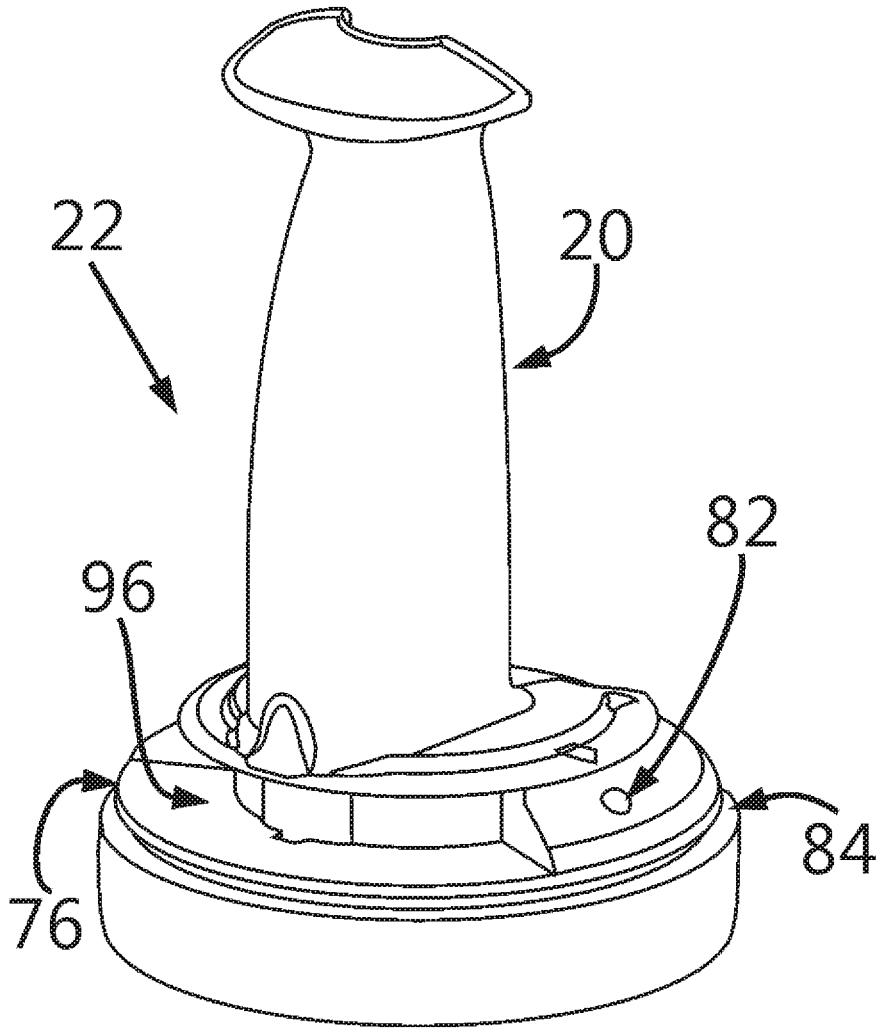

FIG. 11 is an Isometric closeup view of a Handle Cap exposing a Ledge space permitting necessary rotational motion of the Stop Shelf, in accordance with embodiments of the present invention.

DETAILED DESCRIPTION

Invention elements will now be disclosed by reference to drawing figures. Elements will then be described in detail, and functional interactions between invention elements as well as groups of invention elements will then be described.

Figure 1A:
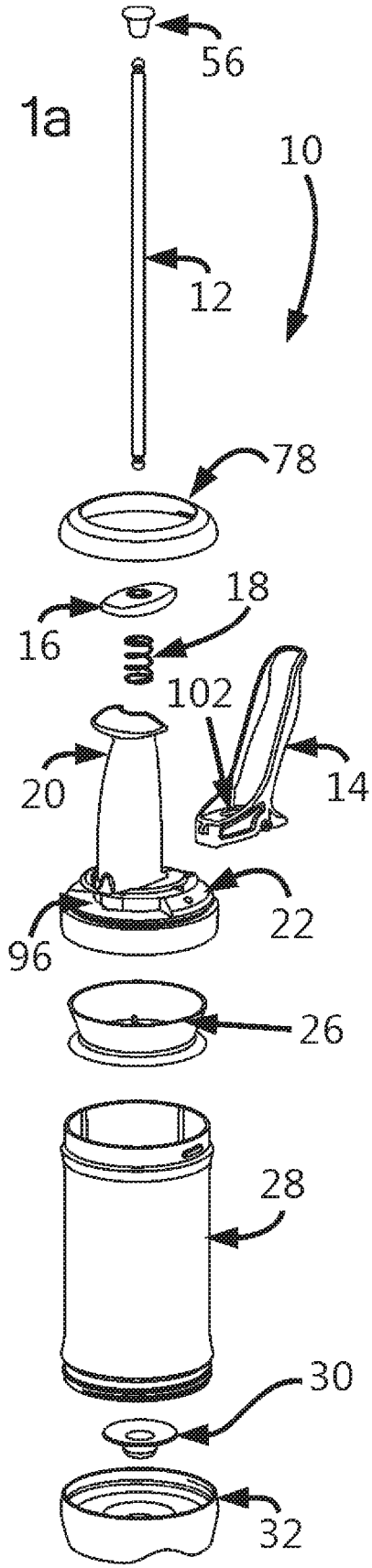
FIG. 1*a*, is an Isometric exploded view of basic Dispenser elements, in accordance with embodiments of the present invention.
Figure 1B:
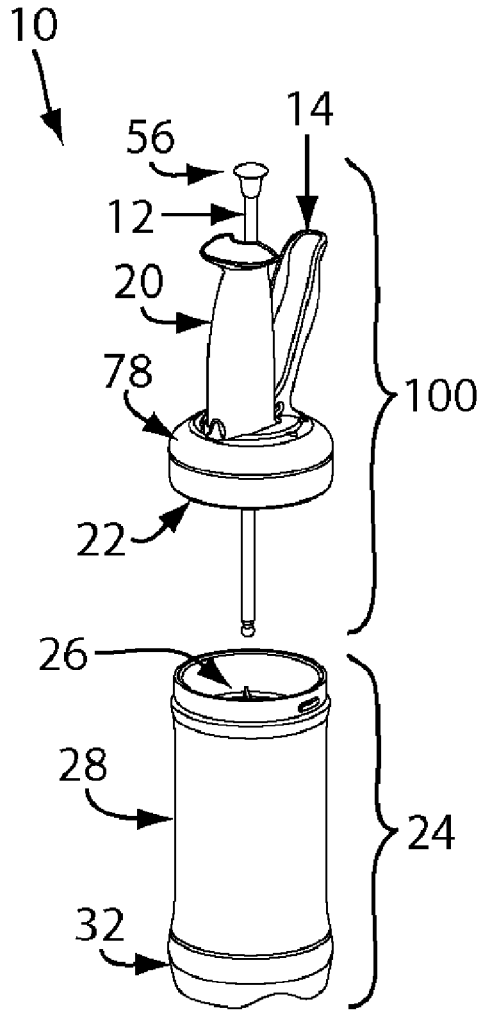
FIG. 1*b*, is an Isometric semi-exploded view of Dispenser elements, in accordance with embodiments of the present invention.

FIG. 1*a*, shows an isometric exploded view of the basic Dispenser 10 elements, namely a rod 12 with a rod cap 56, a plate 16, spring 18, handle 20, handle cap 22, plunger 26, bottle 28, outlet valve 30, and discharge cap 32. Also shown are a portion ring 78, a ledge 96, and a lever 14 with its rod port 102. (Note: a handle cap 22 is a cap that fits onto the top of a bottle 28 with a handle 20 as part of, and integrated with, its essential structure. While the handle 20 cannot be physically separated from the handle cap 22 in at least some embodiments, it can be logically identified as a sub element of its parent structure.) FIG. 1 b shows an isometric semi-exploded view of the dispenser 10 elements separated into two modular halves, namely the dispensing mechanism 100 and its fluent material containing cartridge 24. The dispensing mechanism 100 is comprised of the rod 12 with a rod cap 56 inserting through a plate 16, spring 18, handle 20, and handle cap 22 with its portion ring 78 and lever 14. The cartridge 24 is comprised of the plunger 26 inserted into the top of a bottle 28 with an outlet valve 30 secured into a discharge cap 32 threaded into the bottom. Although an outlet valve is preferred, it is contemplated that vacuum pressure or other means may be used in place of a mechanically opening and closing valve to keep fluid materials of adequate viscosity within the bottle, for example resisting gravity, until the plunger is actuated. A valve in this case may therefore simply refer to an adequately small aperture which causes fluid retention within the bottle until plunger actuation. Various appropriate designs of pressure-actuated valves, such as flexible silicone valves, may be used as would be readily understood to a worker skilled in the art.

Figure 2A:
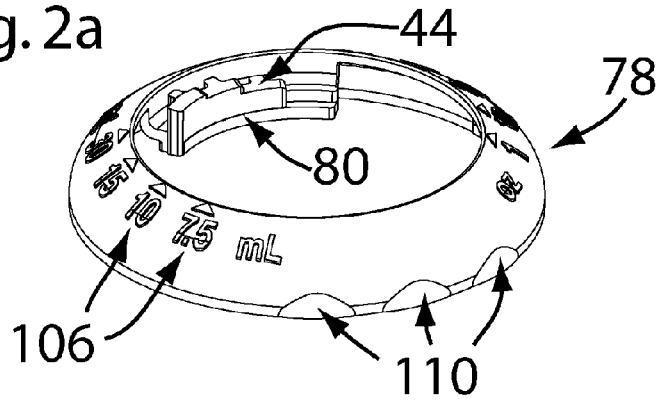
FIG. 2*a*, is an Isometric view of an Adjustable Portion Ring, in accordance with embodiments of the present invention.
Figure 2C:
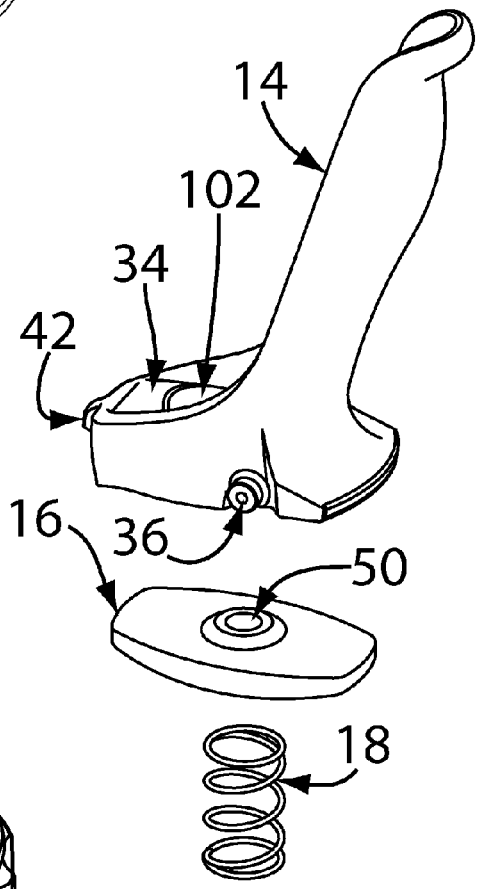
FIG. 2*c*, is an Isometric view of a Lever, Plate & Spring, in accordance with embodiments of the present invention.
Figure 2B:
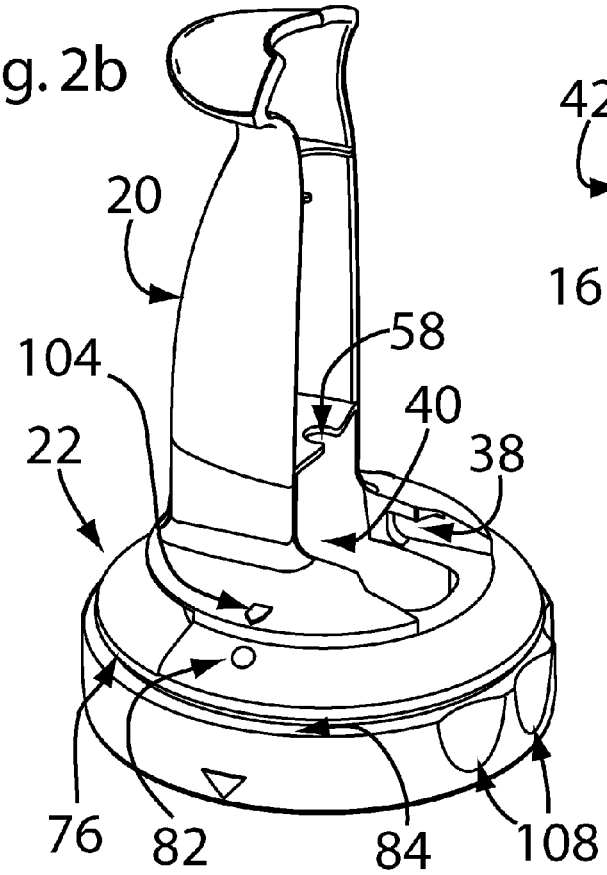
FIG. 2*b*, is an Isometric view of a Handle Cap, in accordance with embodiments of the present invention.

FIG. 2*a*, shows an isometric view of an adjustable portion ring 78 with its stop shelf 80 comprising a number of portion stops 44 of graduating heights. Also shown are portion indicators 106 and finger catches 110. FIG. 2*b*, shows an isometric view of a handle cap 22, handle 20, rod support 58, pin slots 38, lever trench 40, ring detent 76, shoulder 84, finger indents 108, and a bead 82. FIG. 2*c*, shows an isometric view of a standard lever 14 with a rod port 102 through the center of its lever arm 34, lever pins 36 and a tooth 42. Grouped with the lever 14 is a plate 16 with its bushing 50, and a spring 18.

Figure 3A:
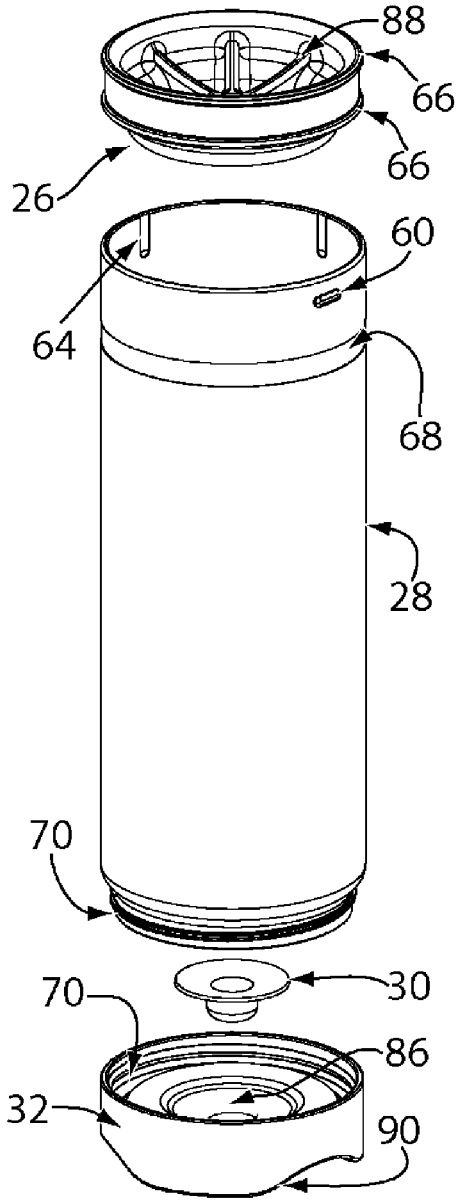
FIG. 3*a*, is an Isometric closeup view of a Plunger, Bottle, Valve & Cap, in accordance with embodiments of the present invention.
Figure 3B:
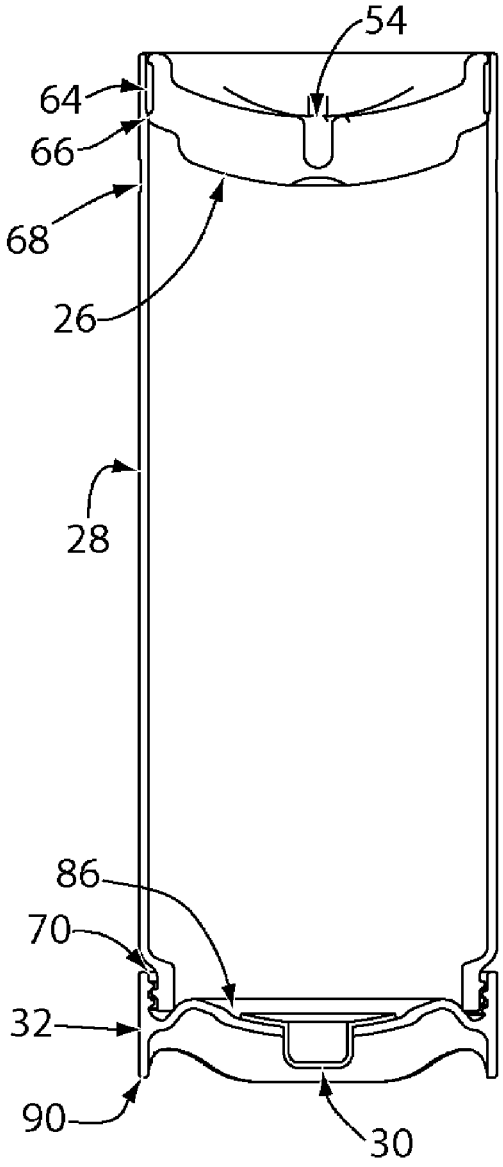
FIG. 3*b*, is a Side Cutaway closeup view of a Cartridge (see FIG. 3*a*), in accordance with embodiments of the present invention.

FIG. 3*a*, shows an isometric closeup view of the elements of a cartridge 24, namely a plunger 26 with one or more flanges 66 and multiplicity of socket stays 88, inserting into a bottle 28 with its vent channels 64, bayonet pin 60, fill zone 68, and enclosed by threading 70 a discharge cap 32 with its outlet valve 30 inserted into its valve seat 86, and supported upright by each foot 90. FIG. 3*b*, shows a side cutaway view of a cartridge 24 assembly of the elements listed in FIG. 3*a*. Also shown in FIG. 3*a* is a rod socket 54 in the center of the plunger 26.

Figure 4B:
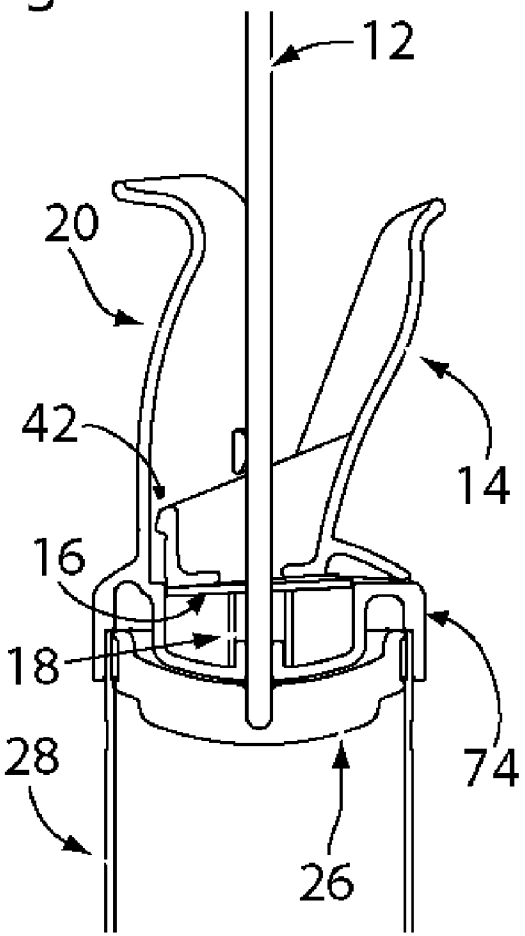
FIGS. 4*a*/4*b*/4*c*/4*d*, are Side Cutaway closeup views of the Dispenser in its Start, Locked, Dispensed, and New Start positions, respectively, in accordance with embodiments of the present invention.
Figure 4A:
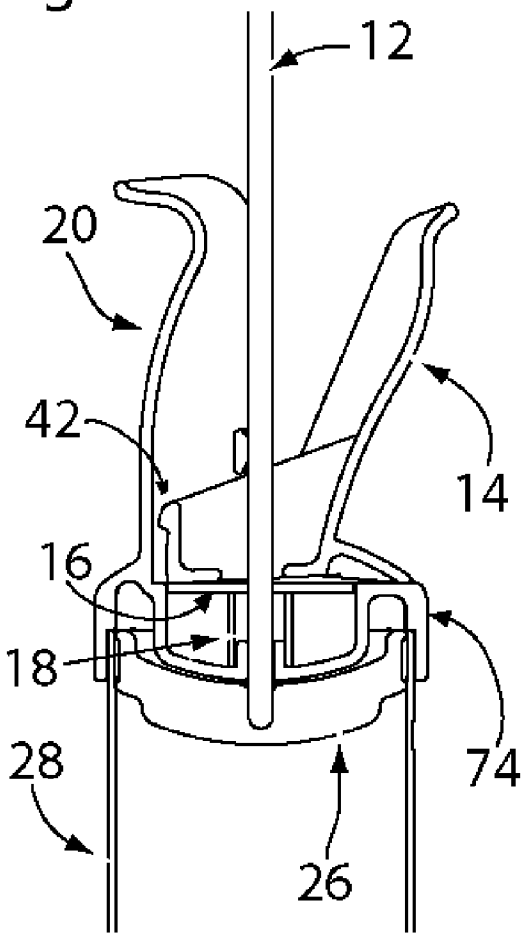
Figure 4D:
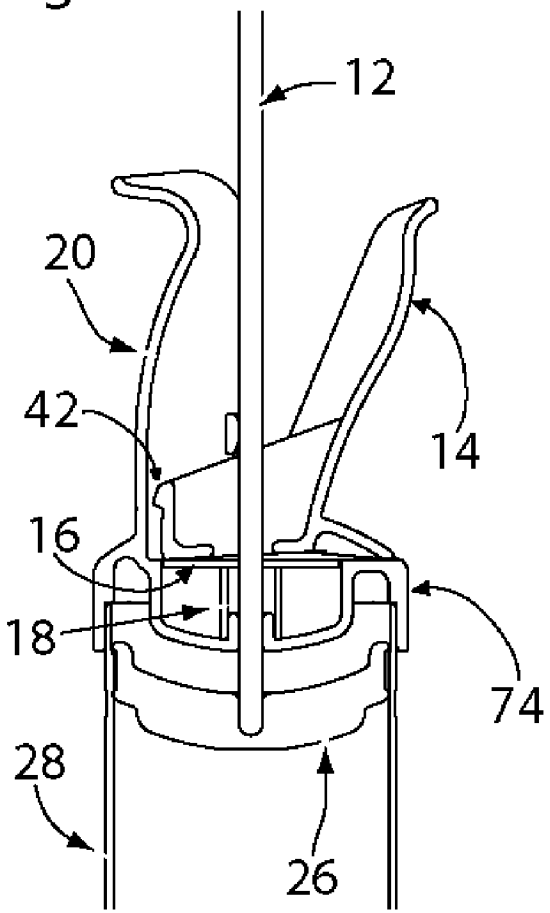
Figure 4C:
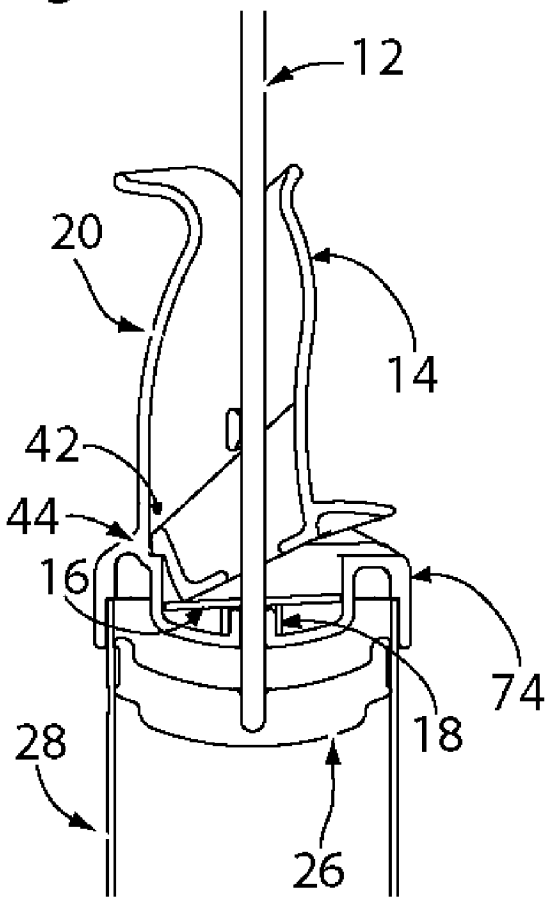

FIGS. 4*a*, 4*b*, 4*c*, & 4*d*, show side cutaway closeup views of the top half of a Dispenser 10 with a ringless handle cap 74, with its handle 20, lever 14, tooth 42, rod 12, plate 16, spring 18, and plunger 26 in their Start, Locked, Dispensing, and New Start positions, respectively. FIG. 4*c*, illustrates how the tooth 42 of the lever 14 is arrested by the portion stop 44 of a ringless handle cap 74. A ringless handle cap 74 is an alternate embodiment which incorporates a non-adjustable portion ring 78 into the base of the handle cap 22. The portion stop 44 may be integrated with the portion ring or into another non-ring-shaped member for attachment to the dispenser.

Figures 5A, 5B, 5C:
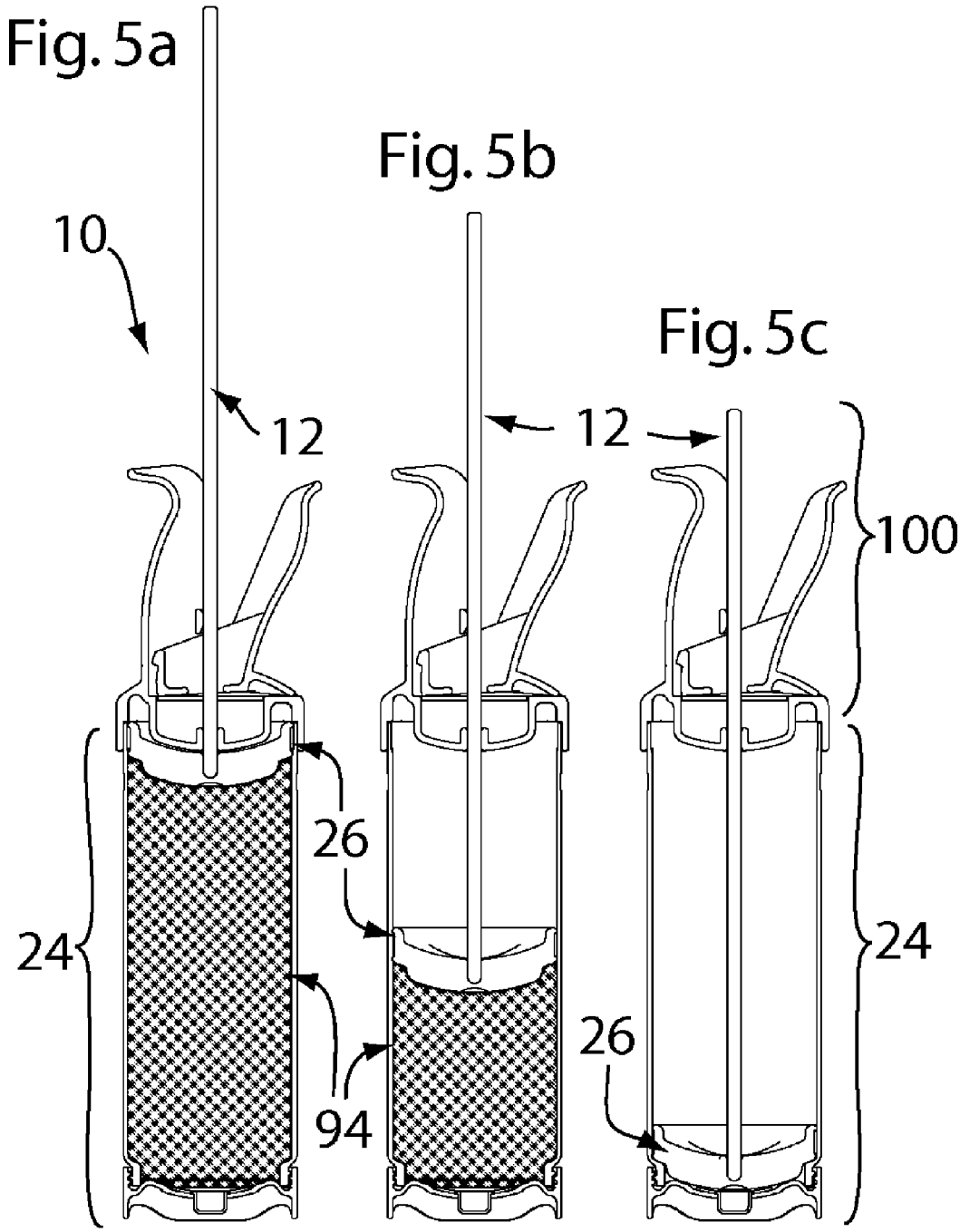
FIGS. 5*a*/5*b*/5*c*, are Side Cutaway views of Dispensers with a Full, Half-Full, and Empty Cartridges, respectively, in accordance with embodiments of the present invention.

FIGS. 5*a*, 5*b*, 5*c*, show side cutaway views of Dispensers 10 with Full, Half-Full, and Empty Cartridges, respectively. (fluent material illustrated by square halftone pattern) FIG. 5*c*, also illustrates how the bottom of the plunger 26 is designed to extrude the maximum amount of fluent material 94 from each cartridge 24.

FIG. 6*a*, shows a top & partial cutaway view of the tooth 42 of a lever 14 positioned above one of several portion stops 44 on the top of a stop shelf 80 protruding from the inside of a portion ring 78. FIG. 6*b*, shows a closeup view of circled area in FIG. 6*a*. FIG. 6*c*, shows a side cutaway view of portion ring 78 with the stop shelf 80 and its graduated portion stops 44. Also shown are four divots 92 that interface with the corresponding bead 82 shown in FIG. 2*b*.

FIG. 7*a*, shows a side cutaway closeup view of the dispensing mechanism 100, with its handle cap 22, handle 20, lever 14 with rod port 102, portion ring 78 and rod 12 showing a rod clip 52. The rod clip 52 may comprise a ball end of the rod, a notch or groove formed within the rod and extending partway or fully around the cylindrical rod, or the like. Internal elements include rod supports 58 in the handle 20, plate 16, spring 18, and spring boss 48. Also shown is how the tooth 42 of the lever 14 is arrested by means of the portion stop 44. FIG. 7*b*, shows an isometric view of the portion ring 78 and related side cutaway views of each portion stop 44 as the portion ring 78 and the stop shelf 80 is rotated (shown by corresponding numbers).

FIG. 8*a*, shows a side cutaway view of a ringless handle cap 74 employing removeable portion levers 98 which each have different travel ranges 46 determined by the size of the tooth 42 at the end of each lever 98. FIG. 8*a*, shows the dispensing mechanism 100 in operation in which the lever is 98 squeezed against the handle 20, which causes the plate 16 and rod 12 to be displaced an equal amount downwards. FIGS. 8*b*, 8*c*, 8*d*, show portion levers 98 with successively smaller travel ranges 46, and also more clearly show the nature of the rod port 102.

FIGS. 9*a*, 9*b*, show isometric and side cutaway views of the rod 12 inserted into the rod socket 54 of the plunger 26. Also shown are the socket stays 88, flange(s) 66 and the rod cap 56.

FIGS. 10*a*, 10*b*, 10*c*, show a top & two side views (90 degrees apart) of the Dispenser 10, respectively. Dispenser 10 elements are shown as part of the dispenser mechanism 100 or the cartridge 24. FIG. 10 also shows a taper 72 in the shape design of the bottle 28. FIG. 10 elements are listed in figures above, except for finger indents 108 and catches 110 found on the handle cap 22 to portion ring 78 interface.

FIG. 11 shows an isometric view of the Ledge 96 in a handle cap 22 that accommodates the stop shelf 80 used with an adjustable portion ring 78 (See FIG. 2*a*). Also shown is the ring indent 76, the shoulder 84, and the bead 82 that interfaces with the divots 92 inside an adjustable portion ring 78.

Dispenser 10 elements will now be described in detail as part of functional groups, namely as elements relating to the Handle Cap 22, Portion Ring 78, Lever 14, Rod 12, Plunger 26, and the Cartridge 24.

Handle Cap elements may include the Handle Cap 22, Handle 20, Ring Detent 76, Bead 82, Shoulder 84, Ledge 96, Indents 108, Lever Trench 40, Spring Boss 48, Pin Slot 38, and the optional Ringless Handle Cap 74. The standard Handle Cap 22, as shown in FIGS. 2*b*, & 11, is the handle 20 formed together with a cap that threads onto the top of a cartridge 24, as shown in FIG. 10*c*. As shown in FIG. 7*a*, the spring 18 is inserted into the lever trench 40 and is fitted onto the spring boss 48. The plate 16 is then fitted over the top of the spring 18, and then the lever 14 is inserted into the lever trench 40 until its lever pins 36 are fully fitted into their respective pin slots 38. A standard handle cap 22 would then require either an adjustable portion ring 78, or a stationary portion ring. The adjustable portion ring 78 as seen in FIG. 2*a*, slides over the handle 20, and is oriented so that its stop shelf 80 is over the ledge 96 (see FIG. 11) on the handle 20 side of the handle cap 22, is snapped over the ring detent 76, and is now able to rotate on the shoulder 84. A bayonet thread 62 is on the inside wall of the handle cap 22 and is used to thread the dispensing mechanism 100 onto the top of the cartridge 24 by means of its bayonet pin(s) 60. (see FIG. 3*a*)

Portion Ring elements include the Portion Ring 78, Stop Shelf 80, Portion Stop 44, Portion Marks 108, Catches 110, and more than one internal divot 92. As shown in FIGS. 6 & 7, the adjustable portion ring 78 provides an adjustable means to stop the travel of the tooth 42 of a lever 14, by rotating the ring 78 to orient the stop shelf 80 to present the required portion stop 44 to dispense a specific volume of fluent material 94. In order to ensure the portion ring 78 moves in controllable increments, hemi-spherical divots 92 in its inner wall may be fitted into a conversely shaped bead in a corresponding location on the handle cap 22. (see FIGS. 2*b*, & 6*c*) A stationary portion ring (a simpler version not shown), is a non-rotating portion ring with only one portion stop 44, and snaps onto the handle cap 22 as with the standard version. Removal of any portion ring (44 or stationary) is effected by inserting fingertips into the indents 108 and tugging upwards on the protruding catches 110 until the portion ring 44 is freed from the body of the handle cap 22. (See FIGS. 2*a*, & 2*b*) Also shown in FIGS. 2*a/b*, is the index mark 104 on the handle cap 22 which interfaces with various portion marks 106 on the (adjustable) portion ring 44 in order to indicate the portion volume selected for dispensing.

Lever elements include the Lever 14, Lever Arm 34, Rod Port 102, Lever Pin 36, Tooth 42, Plate 16, Bushing 50, and Spring 18. When the lever 14 is compressed against the handle 20, the lever arm 34 pivots downwards around the lever pins 36 until the tooth 42 is stopped by a portion stop 44. The plate 16 is shaped to fit into the lever trench 40 and has a reinforced bushing 50 (see FIG. 2*c*) through which the rod 12 can be inserted. In an alternate embodiment (see FIG. 8), a number of Portion Levers 98 can be used with a stationary portion ring wherein each lever's 98 tooth 42 has a different travel range 46 so that each lever 98 pivots to a different depth.

Rod elements include the Rod 12, Rod clip 52, Rod Cap 56, and Rod Support(s) 58. As shown in FIG. 7*a*, the rod 12 is inserted into the assembled handle cap 22 (described above) along the rod supports 58 in the handle 20, through the rod port 102 in the lever arm 34, then through the bushing 50, spring 18 and spring boss 48, and out of the bottom of the handle cap 22. In one embodiment, rod clips such as spherical ball ends 52 are formed at each end of the rod 12 to both secure the rod cap 56 (FIG. 9*a*) and the plunger 26 (FIG. 9*b*).

Plunger elements include the Plunger 26, Flange(s) 66, Socket Stays 88, and the Rod Socket 54. The plunger 26 is a rigid cylinder with flexible flange(s) 66 that pushes the fluent material 94 down the bottle 28 and out the discharge cap 32 by means of the incremental downward motion of the rod 12 attached to the plunger's 26 rod socket 54. (FIGS. 9*a*, & 5*a-c*) The rod socket 54 is reinforced by means of socket stays 88 formed as part of the inside of the plunger 26. Note that there are two plunger 26 designs illustrated (see FIGS. 3*a*, & 9*a*), and both function in a nominally equivalent fashion.

In embodiments of the present invention, and as is readily apparent from the Figures and from construction and operation of the device as described herein, the Plunger 26 and the inner sidewalls of the Bottle 28 are configured for frictional engagement with each other. The amount of frictional engagement is configured, via configuration of the Plunger and Bottle, and in conjunction with configuration of the lever/plate/spring actuation mechanism, such that, when the rod exerts downward pressure on the plunger due to squeezing the lever, the plunger moves with the rod, but when the lever is released, friction between the plunger and bottle sidewalls tends to hold the plunger in place.

Configuration of the Plunger and Bottle may be via one or more of:

sizing, material selection, shaping, and the like. For example, the size of the plunger determines the amount of plunger surface in contact with the bottle, which may contribute to the amount of friction. The tolerance or "tightness of fit" of the plunger within the bottle interior, due to small differences in their diameters, also contributes to the amount of friction. Use of certain plastic materials also defines a particular frictional coefficient. The flexibility, elasticity and/or rigidity of the plunger at least in part determines the amount of force exerted by the plunger against the sidewalls if it is deformed to fit within the bottle.

In some embodiments, and as illustrated in FIGS. 9*a*, and 9*b*, the plunger comprises an upper flange 67 which engages the bottle sidewall and which is disposed to make an acute angle with the rod. In this configuration, and as is readily apparent from the Figures, the upper flange may be more compliant to downward force (exerted by the rod when the lever is squeezed) than it is to upward force (potentially exerted by the rod as the lever is released). This contributes to allowing the plunger to be moved by the rod when squeezing the lever, while also allowing the plunger to stay in place by frictional engagement when the lever is released. The angled upper flange may thus engage the bottle sidewalls with a predetermined configurable amount of friction, and assist in impeding the plunger from upward movement during release of the lever.

The socket stays 88 may be configured, for example via their height, so as to add a predetermined level of reinforcement to the flange 67, thereby adjusting the force exerted thereby. The frictional engagement between the plunger and the bottle sidewalls provides a means for impeding upward movement of the plunger during lever release, said means moving with the plunger during use.

In addition, the distance between the top flange and the bottom flange may be configured in order to provide distal points of contact with the bottle sidewalls, thereby inhibiting the plunger from tilting within the bottle.

The bottom flange may be configured to be as flat as possible, in order that substantially all fluid can be ejected from the bottle. Additionally, while the flanges may deform during motion, a sealing engagement with the bottle sidewalls is maintained.

In some embodiments, the plunger is configured to engage the bottle sidewalls to a sufficient degree to resist an upward force applied to the rod by the bushing during lever release, thereby maintaining the plunger in place against such a force. The mechanics of the bushing-rod engagement are described below.

Squeezing of the lever 14 causes engagement and downward motion of one edge of the plate 16. This in turn results in a slight (possibly imperceptible) pivoting of the plate 16 and the bushing 50, and a corresponding binding of the bushing to the rod. As used herein, "downward" corresponds to the direction of motion of the plunger which would cause compression of the fluid, while "upward" corresponds to the opposite direction. The rod resists further pivoting once engaged, and further squeezing of the lever causes compression of the spring and imparts a downward force and motion on the plate, bushing and rod. This downward force is configured to be strong enough to overcome the frictional engagement between the plunger and bottle sidewalls, so that the plunger moves substantially downward through the bottle.

As the lever is released, the plate and bushing are biased by the spring 18 to move in an upward direction, and the binding between bushing and rod is relaxed. The spring 18 is configured to provide sufficient force to ultimately unbind the bushing from the rod. However, some binding may still exist during at least part of the lever release, and this may result in the bushing applying a relatively upward force to the rod. This upward force is resisted by the frictional engagement between the plunger and bottle sidewalls, so that the plunger remains in place. The various components: plunger, bottle, bushing, spring, plate, and the like, may be co-configured so that the plunger moves downward when the lever is squeezed, but resists upward motion when the lever is released.

In some embodiments, a relief mechanism is provided by which the binding between the bushing and the rod can be broken (e.g. allowing the rod to slip even though the lever is currently being squeezed) more easily by applying relative downward force to the rod than by applying relative upward force to the rod. This facilitates the substantially one-way (downward) motion of the plunger. Specifically, the bushing-rod engagement is strengthened during squeezing of lever, allowing the plunger-bottle frictional engagement to be overcome, and the bushing-rod engagement is weakened during lever release, allowing the plunger-bottle frictional engagement to overcome the bushing-rod engagement. In some embodiments, this relief mechanism may be used in combination with the feature that the upper flange is more compliant to downward force than it is to upward force.

The relief mechanism is described as follows, and will be readily apparent from the Figures and the description herein. As the lever is squeezed, the lever 14 engages the topside of the plate 16, for example as shown in FIGS. 4*c*, and 8*a*. Due to this engagement, the lever, backstopped by a user's hand, inhibits upward force on the plate from being translated into clockwise pivoting (the clockwise direction refers to that illustrated in FIGS. 4*c*, and 8*a*). Note that it is clockwise pivoting that would be required to unbind the bushing from the rod; counterclockwise pivoting is still allowed, yet pivoting in this direction simply increases the binding action. Thus, when the lever is fully or partially actuated, relative upward force applied by the rod against the bushing sidewalls (for example due to plunger friction and/or fluid resistance during compressive motion of the plunger) is robustly opposed.

On the other hand, relative downward force applied by the rod against the bushing sidewalls (for example due to plunger friction during lever release and spring-actuated plate movement), causes a relatively unimpeded clockwise motion of the plate and bushing, since the floating end of the plate (opposite the plate location engaged with the lever) can move downward with the rod. This is so as long as the spring boss does not engage the plate too strongly; the spring itself opposes the clockwise pivot but this force is relatively easy to overcome. This clockwise motion tends to unbind the bushing from the rod and allow downward sliding of the rod.

It is also noted that the rod 12 is maintained in a vertical orientation via at least one of: contact with the rod support 58, connection with the plunger 26, and contact within the spring boss 48. Since the rod orientation is maintained along a single axis, the relative angle between the rod and the bushing can substantially only be changed by pivoting the bushing and plate. The bushing may be located between the rod support and the spring boss, which allows the rod to be held vertically against pressure applied by the tilting plate and bushing, thereby facilitating binding of the rod and the bushing. The rod support is configured to engage the rod on at least one side, said side selected so as to maintain the rod vertically against pressure applied by the bushing when the lever is squeezed. The rod support need not support the rod on a side opposite the at least one side.

Cartridge elements may include the Cartridge 24, Bottle 28, Outlet Valve 30, Discharge Cap 32, Bayonet Pin 60, Vent Channel 64, Fill Zone 68, Threading 70, Taper 72, Foot 90, and Valve Seat 86. The cartridge 24 holds the fluent material 94 when attached to the dispensing mechanism 100, or it can be stored separately. FIG. 3*a*, demonstrates how to assemble the cartridge 24, but filling and inserting the plunger 26 will be discussed below. The bottle 28 is manufactured from translucent material in order to ensure that the level of fluent material 94 is within the fill zone 68 and also so as to compare fluent material 94 volume with any capacity markings (not shown) on the bottle 28. The outlet valve 30 may be a removable pliant normally closed orifice that opens to permit the dispensing of fluent material 94 when the plunger 26 advances material towards the discharge cap 32. As shown in FIGS. 10*b/c*,, the body of the bottle 28 has a pronounced taper 72. This feature may be configured to prevent the bottom lip of one bottle 28 from catching on the upper lip of the discharge cap 32 of an adjacent bottle 28 when one bottle 28 is removed from a number of bottles 28 that are closely stacked together.

A preferred embodiment of the ergonomic portion measuring fluent material dispensing system 10 will now be described in detail, including dispenser's 10 assembly, preparation, and operation. The preferred embodiment described herein employs an adjustable portion ring 78 (FIG. 2*a*) with a standard lever 14 (with a consistent tooth 42 size) and a standard plunger 26 configuration (FIG. 1*a*). The use of stationary portion rings, ringless handle caps or portion levers will be discussed as alternate embodiments below.

Assembly:

Cartridge Assembly:

1. Outlet valve 30 is fitted into the valve seat 86 of the discharge cap 32.
2. Discharge cap 32 is screwed on to the bottle 28 at threading 70.
3. Bottle 28 is filled with a fluent material 94.
4. Plunger 26 is inserted into the top of the bottle 28.

Dispensing Mechanism Assembly

1. Spring 18 is pushed onto the spring boss 48 inside the lever trench 40 of the handle cap 22.
2. Plate 16 is placed on top of the spring 18.
3. Lever 14 is inserted into the handle cap 22 by snapping lever pins 36 into pin slots 38.
4. Portion ring 78 is placed over the handle 20 and lever 14, onto the handle cap 22 with its stop shelf 80 over the corresponding ledge 96.
5. Portion ring 78 is snapped over the ring detent 76 and onto the shoulder 84 of the handle cap 22.
6. Portion ring 78 is rotated to select dispensing volume by aligning the appropriate portion mark 106 with the index mark 104.

Dispenser Assembly:

1. By means of the bayonet thread underneath the handle cap 22, dispensing mechanism 100 screws onto the bayonet pins at top of the Cartridge 24.
2. Rod 12 (with rod cap 56 installed) is inserted through the dispensing mechanism 100 assembly and is snapped into the rod socket 54 of the plunger 26. The rod clip 52 is configured to mate with the rod socket, for example by protrusions of the rod socket gripping a notch or groove of the rod clip. In one embodiment, the notch or groove may be associated with a ball end of the rod. In another embodiment, the notch or groove may be formed at an appropriate location along the cylindrical rod without requiring a ball end.

Preparation:

Cartridge Filling Procedure

1. At the top of the bottle 28 are vent channels 64 and on the outside of the bottle 28 a fill zone 68 is indicated.
2. A bottle 28 assembled with an outlet valve 30 and discharge cap 32 is filled from the top with fluent material 94 to a level within the fill zone 68.
3. The plunger 26 is inserted into the bottle 28 until the top surface of the plunger 26 is flush with the top surface of the bottle 28.
4. The cartridge 24 may then be assembled with a dispensing mechanism 100 as described above, or stored or refrigerated for future use.

Operation:

The volume of fluent material 94 dispensed is directly related to the vertical movement of the plunger 26.

1. Start Position:
   Dispenser mechanism 100 threaded onto filled cartridge 24, rod 12 inserted and seated into the rod socket 54. (see FIGS. 4*a/b/c/d*)
2. Locked Position:
   Lever 14 is incrementally squeezed against the handle 20, causing the lever arm 34 to pivot downwards, until pressure on the top of the plate 16 causes the rod 12 passing through the plate 16 to bind on its bushing 50. This position, wherein the lever 14 now has control over the rod 12 by means of the plate 16 is known as the locked position.
3. Dispensing Position:
   As the lever 14 is squeezed, further compressing the spring 18, the locked plate 16 forces the rod 12 and plunger 26 down into the bottle 28, thereby dispensing a quantity of fluent material 94.
4. New Start Position:
   When the lever 14 is released, the compressed spring 18 forces the plate 16 to return to its new horizontal starting position, which unbinds it from the rod 12. The plunger 26 and rod 12 remain in their new position, thereby ensuring a continuous seal over the top of the fluent material 94 in the cartridge 24.

Plunger/Vent Channel Operation:

The plunger 26 is designed to make a continuous double seal with the bottle 28 while at the same time acting (in concert with vent channels 64) as a one way valve when inserted into a properly filled bottle 28. Vent channels 64 allow air to escape from the top of the bottle 28 as the plunger 26 is inserted into a bottle 28 filled to the level of the fill zone 68. The vent channels 64 prevent any fluent material 94 from being inadvertently dispensed through the outlet valve 30 at the bottom of cartridge 24 when the plunger 26 is fully inserted into top of the bottle 28. Vent channels 64 eliminate any airspace between the plunger 26 and the fluent material 94 by allowing air to escape as the plunger 26 is inserted. Repeatable undamped plunger 26 movement is ensured which provides accurate dispensing of fluent material 94 through the outlet valve 30 and leakage prevention. Eliminating any air between the plunger 26 and the fluent material 94 ensures that the last portion is dispensed in exactly the same manner as the first.

As with many prior art designs, if air is present between the plunger 26 and the fluent material 94 then the final dispensed volume(s) will be a mixture of fluent material 94 and air. The air present between the plunger 26 and fluent material 94 is of a lower density and is subject to compression during dispensing. The resulting pressure will equalize over time causing fluent material to escape uncontrollably. This results in unpredictable end of bottle dispensing volumes and inadvertent fluent material 94 splattering which will affect the flavor profile and/or the appearance of the food being produced. The height and operation of the vent channels 64 is such that when the plunger 26 has been correctly inserted there is a complete seal between the bottle 28 and the plunger 26. By this means, cartridges 24 of fluent material 94 may be safely stored with a much lowered risk of leakage or product contamination.

Portion Ring Operation:

In at least some embodiments, a feature of the ergonomic portion measuring fluent material dispensing system 10 is its ability to both control and vary the output of the dispenser 10 as required. Travel range 46 (see FIG. 8) is the distance a lever 14 can advance the rod 12 and plunger 26 during the dispensing operation. Travel range 46 can be adjusted by either varying the size of the tooth 42 at the end of a lever 14 (see alternate embodiments), or by varying the portion stop 44 height. In this preferred embodiment, the latter is achieved by means of an adjustable portion ring 78 with a stop shelf 80 comprised of a number portion stops 44 of different heights. The portion ring 78 is rotated to a selected position, as indicated by aligning the appropriate portion mark 106 with the index mark 108. As illustrated in FIG. 7*b*, a portion stop 44 of the selected height arrests the travel of the lever's 14 tooth 42 and the advance of the rod 12 and plunger 26, and this results in a precise quantity of fluent material 94 being dispensed. In this way, portion dispensing volumes can be adjusted during use without disassembly of the dispenser 10 by simple rotation of the adjustable portion ring 78.

In order to facilitate that the portion ring 78 securely rotates into each selected position, a bead 82 protrudes from the handle cap as shown on FIG. 2*b*. As shown in FIG. 6*c*, a number of divots 92 (equal to the number of portion stops 44) wherein the bead 82 fits, thereby creating stable and adjustable portion ring 78 positioning. Beads 82 and divots 92 are one complimentary détente mechanism and method whereby the portion ring 78 can be rotated incrementally so that the appropriate portion stop 44 is in line with the tooth 42 of the lever 14 (FIGS. 6*a/b*), but other means to achieve the same results may be employed.

Alternate embodiments of the dispensing system 10 will now be described in detail, including the use of portion levers 98, stationary portion rings and ringless handle caps 74.

Portion Levers:

In one implementation of the dispensing system 10 portion adjustment is achieved by selecting different portion levers 98 which dispense a selected portion volume depending on the travel range 46 provided by the size of the tooth 42 at the end of each portion lever 98. (FIGS. 8*a/b/c/d*) In this embodiment, adjustable portion rings are redundant, therefore a ringless handle cap 74 can be used which is a handle cap 22 which has one embedded portion stop at the height required to permit the similar travel ranges as when using adjustable portion rings. For example, the portion levers 98 shown from left to right in FIGS. 8*a-d*, dispense volumes of 1 oz., ½ oz., ⅓ oz., and ¼ oz., respectively. If other dispensing volumes are required, as long as their travel range 46 can allow the plate 16 to be depressed the required distance for the needed fluent material 94 output volume, portion levers 98 can be designed to dispense a multiplicity of output volumes.

Dispensing Mechanism Assembly (Portion Lever)

1. Spring 18 is pushed onto the spring boss 48 inside the lever trench 40 of the handle cap 22.
2. Plate 16 is placed on top of the spring 18.
3. Portion lever 98 is inserted into a ringless handle cap 74 by snapping lever pins 36 into pin slots 38.

Stationary Portion Rings:

A stationary portion ring is a non-adjustable portion ring that has portion stop 44 with only one height. If a user only needs a few selected portion volumes for each dispensing mechanism 100, they would be able to adjust the portions by swapping stationary portion rings appropriately. By this means, assembly of the dispensing mechanism 100 is simplified.

The preferred materials for constructing the dispensing system 10 will now be described. Levers, rings, and handle caps are made from polypropylene. The bottle is made from translucent polypropylene. Rod caps and discharge caps are made from high-density polyethylene. Plates are made from glass filled Nylon, while its bushing and the rod are made from stainless steel. The spring is made from corrosion resistant spring steel. The plunger is made from a hybrid of mainly low-density polyethylene and polyoxymethylene. The outlet valve is made from pliant vulcanized silicone. If necessary, o-rings and pliant seals may be employed to ensure cartridge integrity.

In some embodiments, a combination of interchangeable levers and interchangeable and/or rotatable portion rings can be employed to provide a range of portioning options. For example, interchanging levers can provide for coarse adjustment of the portion, while interchanging or adjusting a portion ring can provide for fine adjustment.

The foregoing description of the preferred apparatus and method of operation should be considered as illustrative only, and not limiting. Other embodiments are not ruled out or similar methods leading to the same result. Other forming techniques and other materials may be employed towards similar ends. Various changes and modifications will occur to those skilled in the art, without departing from the true scope of the invention as demonstrated in the present disclosure and as described in the following claims.

Drawing Elements:

10 Ergonomic Portion Measuring Fluent Material Dispensing System
12 Rod
14 Lever
16 Plate
18 Spring
20 Handle
22 Handle Cap
24 Cartridge
26 Plunger
28 Bottle
30 Outlet Valve
32 Discharge Cap
34 Lever Arm
36 Lever Pin
38 Pin Slot
40 Lever Trench
42 Tooth
44 Portion Stop
46 Travel Range
48 Spring Boss
50 Bushing
52 Rod Clip
54 Rod Socket
56 Rod Cap
58 Rod Support
60 Bayonet Pin
62 Bayonet thread
64 Vent Channel
66 Flange
67 Upper Flange
68 Fill Zone
70 Threading
72 Taper
74 Ringless Handle Cap
76 Ring Detent
78 Portion Ring
80 Stop Shelf
82 Bead
84 Shoulder
86 Valve Seat
88 Socket Stay
90 Foot
92 Divot
94 Fluent Material
96 Ledge
98 Portion Lever
100 Dispensing Mechanism
102 Rod Port
104 Index Mark
106 Portion Lever
108 Finger Indent

What is claimed is:

1. A fluent material dispensing system comprising:

a bottle configured for holding the fluent material;

a plunger configured for sliding engagement with inner sidewalls of the bottle, the plunger further configured to exert a compressive force on the fluent material when travelling through the bottle interior in a first direction, thereby facilitating expulsion of the fluent material through an outlet of the bottle; and a dispensing mechanism, the dispensing mechanism comprising:

a lever operable between a rest position and an engaged position;

a plate having a plate aperture, the plate movable between an upper position and a lower position;

a rod passing through said plate aperture, the rod operatively coupled to the plunger and extending along the first direction, wherein pivoting motion of the lever from the rest position to the engaged position causes the plate to bind with the rod and move in the first direction from the upper position to the lower position, the plate and the rod thereby causing the plunger to travel in the first direction; and a spring configured to bias the plate to maintain contact with the lever during motion of the lever;

a cap for attachment to an end of the bottle opposite the outlet; and a handle attached to the cap, the lever pivotally coupled to the cap, the lever and the handle extending away from the bottle along an axis which is aligned with the first direction and which passes substantially through a center of the bottle, wherein a pivoting return motion of the lever from the engaged position to the rest position causes the plate to at least partially unbind from the rod and move from the lower position to the upper position under bias of said spring and wherein the rod extends along the axis through an aperture formed in the cap, the rod further extending through a gap formed within the lever, the gap located between a hand-actuated portion of the lever and a plate contacting portion of the lever.

2. The dispensing system of claim 1, further comprising a discharge cap configured for operative coupling to the bottle and for holding a valve seated thereon, the outlet comprising the valve, and wherein an outer surface of the bottle comprises a taper, the taper configured to inhibit one bottle from catching on the discharge cap of an adjacent bottle.

3. The dispensing system of claim 1, wherein the handle comprises a flange, the flange configured to rest on a user's hand so that the dispensing system can be held in an ungrasped manner with the user's hand being between the flange and the bottle outlet.

4. A fluent material dispensing system comprising:

a bottle configured for holding the fluent material;

a plunger configured for sliding engagement with inner sidewalls of the bottle, the plunger further configured to exert a compressive force on the fluent material when travelling through the bottle interior in a first direction, thereby facilitating expulsion of the fluent material through an outlet of the bottle; and a dispensing mechanism comprising:

a lever operable between a rest position and an engaged position, the dispensing mechanism configured to cause the plunger to travel in the first direction as the lever moves from the rest position to the engaged position, wherein a distance travelled of the plunger in the first direction increases with a distance travelled by the lever from the rest position to the engaged position: and a portioning mechanism configured to limit the distance travelled by the lever from the rest position to the engaged position to a defined amount, thereby limiting the distance travelled by the plunger to limit an expelled amount of the fluent material to a corresponding defined portion, wherein limiting the distance travelled by the lever comprises placing a portion stop at a defined location along a path of travel of the lever, the portion stop defining the engaged position by direct contact between the portion stop and the lever, the portion stop configured to maintain its defined location relative to motion of the dispensing mechanism, wherein the portion stop is replaceable with an alternate portion stop placed at an alternate defined location along a path of travel of the lever, the alternate portion stop defining an alternate engaged position different from the engaged position, thereby limiting the expelled amount of the fluent material to a different defined portion, and wherein the portion stop and the alternate portion stop are mounted on a portion ring, the portion ring rotatably coupled to the dispensing mechanism, and wherein replacing the portion stop with the alternate portion stop is performed by rotation of the portion ring.

5. The dispensing system of claim 4, wherein the lever comprises a tooth protruding a defined distance from the lever along a path travel of the lever, the distance travelled by the lever limited by direct contact of the tooth with the portion stop or the alternate portion stop located within the path of travel, and wherein the dispensing mechanism further comprises a cap for attachment to an end of the bottle, said portion stop and alternate portion stop being in a fixed position relative to the cap during operation of the lever.

6. The dispensing system of claim 1, wherein the lever comprises a tooth protruding a defined distance from the lever along a path of travel of the lever, the distance travelled by the lever limited by direct contact of the tooth with a portion stop located within the path of travel of the lever, said portion stop being in a fixed position relative to the cap, and wherein the lever is replaceable with an alternate lever having an alternate tooth, the alternate tooth protruding an alternate defined distance from the alternate lever along a path of travel of the alternate lever, the alternate defined distance different from the defined distance, the alternate distance travelled by the alternate lever limited by contact of the alternate tooth with the portion stop, said contact defining an alternate engaged position different from the replaced lever engaged position, thereby limiting the expelled amount of the fluent material to a different defined portion.

7. The dispensing system of claim 1, wherein the hand-actuated portion of the lever and the plate-contacting portion of the lever are located on opposite sides of a fulcrum of the lever.

8. A fluent material dispensing system comprising:

a bottle configured for holding the fluent material;

a plunger configured for sliding engagement with inner sidewalls of the bottle, the plunger further configured to exert a compressive force on the fluent material when travelling through the bottle interior in a first direction, thereby facilitating expulsion of the fluent material through an outlet of the bottle; and a dispensing mechanism comprising:

a lever operable between a rest position and an engaged position, the dispensing mechanism configured to cause the plunger to travel in the first direction as the lever moves from the rest position to the engaged position, wherein a distance travelled of the plunger in the first direction increases with a distance travelled by the lever from the rest position to the engaged position;

a portioning mechanism configured to limit the distance travelled by the lever from the rest position to the engaged position to a defined amount, thereby limiting the distance travelled by the plunger to limit an expelled amount of the fluent material to a corresponding defined portion, wherein limiting the distance travelled by the lever comprises placing a portion stop at a defined location along a path of travel of the lever, the portion stop defining the engaged position by direct contact between the portion stop and the lever, the portion stop configured to maintain its defined location relative to motion of the dispensing mechanism;

a plate having a plate aperture, the plate movable between an upper position and a lower position; and a rod passing through said aperture, the rod operatively coupled to the plunger and extending along the first direction, wherein pivoting motion of the lever from the rest position to the engaged position causes the plate to bind with the rod and move in the first direction from the upper position to the lower position, the plate and the rod thereby causing the plunger to travel in the first direction; and a spring configured to bias the plate to maintain contact with the lever during motion of the lever, wherein a pivoting return motion of the lever from the engaged position to the rest position causes the plate to at least partially unbind from the rod and move from the lower position to the upper position under bias of said spring, and wherein the rod extends through a gap formed within the lever, the gap located between a hand-actuated portion of the lever and a plate-contacting portion of the lever, the plate-contacting portion of the lever and the portion stop located on same side of said gap.

9. The dispensing system of claim 1, the handle further comprising a rod support aligned with the aperture formed in the cap, the rod support configured to aid in maintaining orientation of the rod parallel to the first direction.

10. The dispensing system of claim 1, wherein one or more channels are formed in a region of the inner sidewalls of the bottle, said region being distal from the outlet of the bottle, the channels being free from occupation by the plunger and facilitating expulsion of air from the bottle and around the plunger as the plunger is brought into contact with the fluent material, thereby inhibiting inadvertent fluent material escape during dispensing system assembly.

11. The dispensing system of claim 1, wherein the plunger is configured to frictionally engage the inner sidewalls of the bottle to a degree sufficient for holding the plunger substantially in place against a force oriented opposite the first direction, the force applied by the dispensing mechanism due to the pivoting return motion of the lever.

12. The dispensing system of claim 11, wherein the plunger comprises a resilient clip configured for mating engagement with the rod in response to an engagement force applied to the rod in the first direction, said engagement force being insufficient to overcome frictional engagement of the plunger with the inner sidewalls, thereby allowing engagement of the rod with the plunger without undesired travel of the plunger and corresponding dispense of fluent material.

13. The dispensing system of claim 11, wherein the plunger comprises two spaced-apart, flexible flanges configured for frictional engagement with the inner sidewalls of the bottle, and wherein one of the flexible flanges extends at an angle toward the bottle sidewalls and opposite the first direction, said one of the flexible flanges thereby configured to exhibit a reduced compliance when subjected to the force oriented opposite the first direction, said reduced compliance relative to compliance of said one of the flexible flanges during travel in the first direction, said reduced compliance facilitating frictional engagement of said one of the flexible flanges with the inner sidewalls for holding the plunger substantially in place against the force oriented opposite the first direction.

* * * * *